US009353755B2

(12) United States Patent
Nagano et al.

(10) Patent No.: US 9,353,755 B2
(45) Date of Patent: May 31, 2016

(54) TURBOMOLECULAR PUMP DEVICE

(75) Inventors: Yoshihiro Nagano, Kyoto (JP); Masaki Ohfuji, Kyoto (JP); Junichiro Kozaki, Kyoto (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 774 days.

(21) Appl. No.: 13/581,973

(22) PCT Filed: Mar. 11, 2010

(86) PCT No.: PCT/JP2010/054140

§ 371 (c)(1),
(2), (4) Date: Aug. 30, 2012

(87) PCT Pub. No.: WO2011/111209

PCT Pub. Date: Sep. 15, 2011

(65) Prior Publication Data

US 2012/0321442 A1 Dec. 20, 2012

(51) Int. Cl.
*F04D 19/04* (2006.01)
*F04D 25/06* (2006.01)
*F04D 29/58* (2006.01)

(52) U.S. Cl.
CPC ..... *F04D 19/042* (2013.01); *F04D 25/068* (2013.01); *F04D 29/5813* (2013.01)

(58) Field of Classification Search
CPC . F04D 29/5813; F04D 19/042; F04D 25/068; H05K 7/20; H05K 7/20127; H05K 7/20154; H05K 7/20254; H05K 7/2039; H05K 7/20436; H05K 7/20509; H05K 7/20518; H05K 7/2089; H05K 7/209; H05K 7/20927
USPC ..... 417/373, 423.4, 423.8; 361/690, 702, 361/704, 720, 721, 790; 165/185; 310/52–65; 454/184; 363/141; 338/53–58
See application file for complete search history.

(56) References Cited

U.S. PATENT DOCUMENTS 4,788,627 A * 11/1988 Ehlert et al. ..... 361/717
5,190,438 A 3/1993 Taniyama et al.
5,319,292 A * 6/1994 Backstrand ..... 318/371
5,971,725 A 10/1999 de Simon et al.

(Continued)

FOREIGN PATENT DOCUMENTS

CN 1055800 A 10/1991
DE 3933956 A * 4/1991 ..... H01C 1/082

(Continued)

OTHER PUBLICATIONS

Machine Translation of Japanese Patent JP11-173293 to Akiko et al.*

(Continued)

*Primary Examiner* — Peter J Bertheaud
*Assistant Examiner* — Dnyanesh Kasture
(74) *Attorney, Agent, or Firm* — Westerman, Hattori, Daniels & Adrian, LLP

(57) ABSTRACT

A turbomolecular pump device includes: a turbomolecular pump main body; a power unit that drives the turbomolecular pump main body; and a water cooling unit that is provided between the turbomolecular pump main body and the power unit, wherein components provided in a casing of the power unit are classified into an intensive cooling required component that requires intensive cooling, a moderate cooling required component that requires moderate cooling, and a no cooling required component that requires substantially no cooling, the intensive cooling required component is mounted on a first high-conductivity substrate contacting to the water cooling unit, the moderate cooling required component is mounted on a second high heat-conductive substrate contacting to an inner surface of the casing, and the no cooling required component is mounted on a substrate arranged in a space between the first high heat-conductive substrate and the second high heat-conductive substrate.

9 Claims, 12 Drawing Sheets

(56) References Cited

U.S. PATENT DOCUMENTS

| | | | | |
|---|---|---|---|---|
| 6,313,988 | B1 * | 11/2001 | Pham | 361/679.33 |
| 7,965,510 | B2 * | 6/2011 | Suzuki et al. | 361/699 |
| 8,651,838 | B2 * | 2/2014 | Birkenstock et al. | 417/423.4 |
| 2002/0131877 | A1 | 9/2002 | Omori | |
| 2003/0067748 | A1 | 4/2003 | Tamba et al. | |
| 2007/0144800 | A1 * | 6/2007 | Stone | 180/65.3 |
| 2007/0235180 | A1 * | 10/2007 | Ouyang et al. | 165/287 |
| 2008/0266047 | A1 * | 10/2008 | Vetter et al. | 338/267 |
| 2009/0224704 | A1 * | 9/2009 | Ibori et al. | 318/376 |
| 2010/0027220 | A1 * | 2/2010 | Hughes et al. | 361/702 |
| 2010/0127818 | A1 * | 5/2010 | Ishikawa et al. | 338/51 |
| 2011/0058284 | A1 * | 3/2011 | Katsumata | 361/18 |

FOREIGN PATENT DOCUMENTS

| | | | | |
|---|---|---|---|---|
| JP | 03-252191 | A | 11/1991 | |
| JP | 10-131887 | A | 5/1998 | |
| JP | 11-173293 | * | 6/1999 | F04D 19/04 |
| JP | 2003-116282 | A | 4/2003 | |
| JP | 2003-222096 | A | 8/2003 | |
| JP | 2004-128099 | A | 4/2004 | |
| JP | 2006-090251 | A | 4/2006 | |
| JP | 2006-274960 | A | 10/2006 | |

OTHER PUBLICATIONS

Machine Translation of German Patent DE 3933956 A to Bauman et al.*

Chinese Office Action dated Sep. 12, 2014, issued in corresponding Chinese Application No. 201080065127.1; w/English Translation. (14 pages).

International Search Report of PCT/JP2010/054140, mailing date Jun. 15, 2010.

* cited by examiner

TURBOMOLECULAR PUMP DEVICE

TECHNICAL FIELD

The present invention relates to a turbomolecular pump device.

BACKGROUND ART

A turbomolecular pump device is configured to drive a rotor provided with rotary vanes by a motor to rotate at a high speed with respect to stator vanes to thereby evacuate gas molecules and is used in connection with various types of vacuum processing devices. Examples of turbomolecular pumps of this kind includes one that is provided with a water cooling structure for cooling the motor main body and the power unit (for example, the patent literature 1).

CITATION LIST

Patent Literature

Patent Literature 1: Japanese Laid-open Patent Publication No. 2006-274960

SUMMARY OF INVENTION

Technical Problem

The water cooling structure is suitable for locally cooing a limited portion (portion having a shape that is easy to cool). However, when it is intended to cool a relatively wide area such as a power unit of a turbomolecular pump, merely providing a water cooling mechanism will result in insufficient cooling. It may be conceived to use a cooling fan unit in combination with the water cooling mechanism. However, taking into consideration the short service life of fans, it is inappropriate to adopt the cooling fan unit.

Solution to Problem

A turbomolecular pump device according to the present invention comprises: a turbomolecular pump main body; a power unit that drives the turbomolecular pump main body; and a water cooling unit that is provided between the turbomolecular pump main body and the power unit, wherein components provided in a casing of the power unit are classified into an intensive cooling required component that requires intensive cooling, a moderate cooling required component that requires moderate cooling, and a no cooling required component that requires substantially no cooling, the intensive cooling required component is arranged in a first space for cooling by heat transfer to the water cooling unit, the moderate cooling required component is arranged in a second space for cooling by heat transfer to an inner surface of the casing, and the no cooling required component is arranged in a third space for cooling by radiation or local convection within the casing.

It is preferable that the intensive cooling required component is mounted, in the first space, on a first substrate that is in contact with the water cooling unit, the moderate cooling required component is mounted on a second substrate that is in contact with the inner surface of the casing, and the no cooling required component is mounted on a third substrate arranged in the third space between the first substrate and the second substrate.

When the intensive cooling required component is insulated, it is preferable that the intensive cooling required component is mounted, in the first space, in contact with the water cooling unit. And, when the moderate cooling required component is insulated, it is preferable that the moderate cooling required component is mounted, in the second space, in contact with the inner surface of the casing.

When the intensive cooling required component is not insulated, it is preferable that the intensive cooling required component is mounted, in the first space, in contact with the water cooling unit via an insulation sheet. And, when the moderate cooling required component is not insulated, it is preferable that the moderate cooling required component is mounted in contact with the inner surface of the casing via an insulation sheet that is in contact with the inner surface of the casing.

It is preferable that the substrate, on which the no cooling required component is mounted constituted by glass epoxy or phenol resin, and that the substrate constituted by glass epoxy or phenol resin is supported by the water cooling unit or the first substrate so that the substrate is arranged at a position separate from the first and the second substrates.

When the turbomolecular pump main body comprises stator vanes, rotary vanes, a rotor that rotates the rotary vanes, and a rotor motor that drives the rotor, then the power unit comprises a power system circuit including a three-phase inverter that drives the rotor motor, a power device that controls the inverter, a regeneration brake resistor that converts regeneration power from the rotor motor into heat, and the like. The three-phase inverter and the power device as the intensive cooling required components may be arranged in the first space, and the regeneration brake resistor may be arranged in contact with the water cooling unit.

When the turbomolecular pump main body comprises stator vanes, rotary vanes, a rotor that rotates the rotary vanes, and a rotor motor that drives the rotor, then the power unit comprises a power system circuit including a three-phase inverter that drives the rotor motor, a power device that controls the inverter, a regeneration brake resistor that converts regeneration power from the rotor motor into heat, and the like. The three-phase inverter and the power device as the intensive cooling required components may be arranged, in the first space, on a first substrate, and the regeneration brake resistor may be arranged in contact with the water cooling unit.

For the first substrate, on which the three-phase inverter and the power device are mounted, a high heat-conductive substrate such as a metal-based substrate, a substrate with metal core, and a ceramic substrate employing a ceramic of high heat-conductivity like aluminum nitride may be used. In this case, the regeneration brake resistor may be ring-shaped, and the high heat-conductive first substrate may be arranged on an inner side of the ring-shaped regeneration brake resistor.

For the regeneration brake resistor, a sheathed heater may be employed.

In any of the above explained turbomolecular pump devices, the turbomolecular pump main body may comprise a pump main body casing of inlet side and a base casing of outlet side, which are connected with bolts on their flanges. Further, the water cooling unit comprises a flat-shaped water cooled jacket provided with a conduit for cooling water. The base casing is connected via a flange thereof with bolts to an upper side of the water cooled jacket, so that an outer circumference of the water cooled jacket is fitted into an open end of the casing of the power unit and connected with bolts enabling to prevent the water cooled jacket from rotating.

Advantageous Effect of the Invention

According to the present invention, each component that constitutes the power unit can be cooled efficiently without using any cooling fan unit.

DESCRIPTION OF EMBODIMENTS

A turbomolecular pump device according to an embodiment of the present invention is explained with reference to FIGS. 1 to 10. The turbomolecular pump device is configured to drive a rotor provided with rotary vanes by a motor to rotate at a high speed with respect to stator vanes to thereby evacuate gas molecules. The turbomolecular pump device of this type is used in connection with various types of vacuum processing devices.

Figure 1:
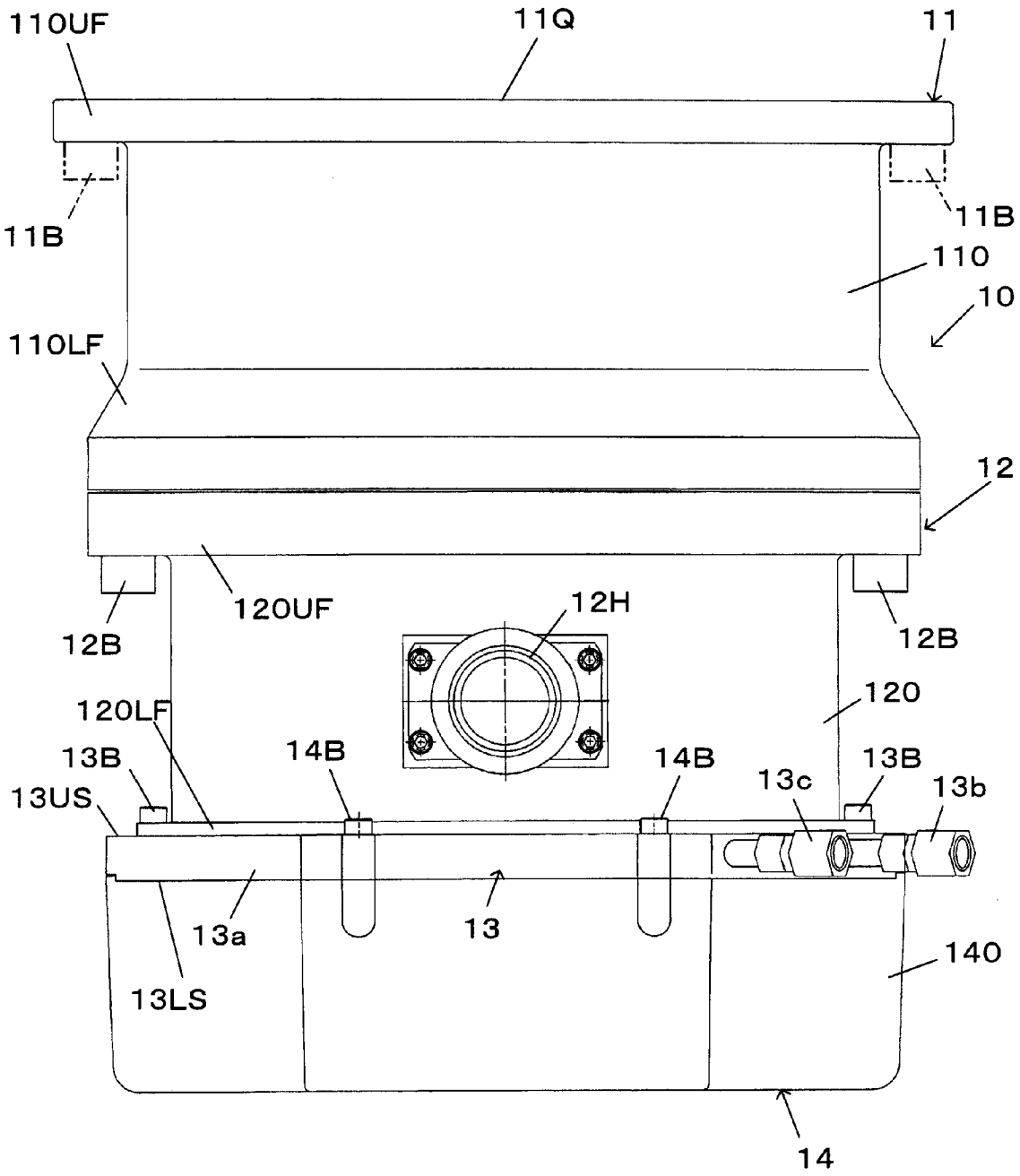
FIG. 1 An external view of a turbomolecular pump device.

FIG. 1 shows the external view of a turbomolecular pump device 10 according to an embodiment of the present invention. The turbomolecular pump device 10 includes a pump main body 11 that does evacuation, a base 12, a cooling unit 13, and a power unit 14 that drives and controls the pump main body 11. The pump main body 11 has a well known structure and detailed explanation thereof is omitted. It mainly comprises a rotating body including a rotor with rotary vanes and a rotary shaft, stator vanes that cooperate with the rotary vanes, and a motor that drives the rotating body to rotate. The rotating body is non-contact supported with magnets that constitute a five-axis magnetic bearing. The rotating body that is rotatably magnetically levitated by the magnetic bearing is driven by a motor to rotate at a high speed to thereby rotate the rotary vanes at a high speed with respect to the stator vanes, thereby sucking gas molecules from a vacuum processing apparatus (not shown) connected to an inlet port 11Q and evacuating the gas molecules from a outlet port 12H to which a back port is connected.

Figure 2:
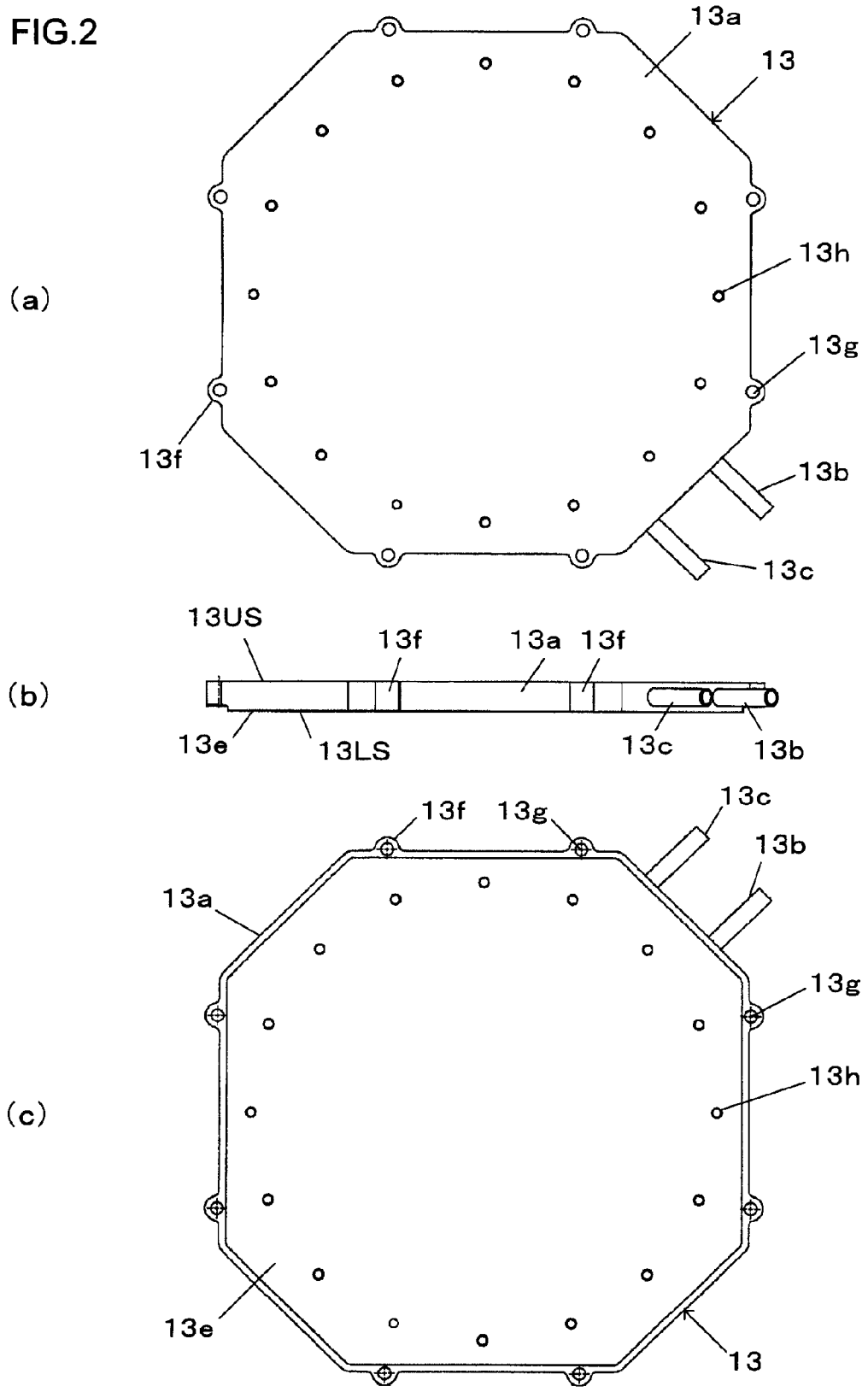
FIG. 2 A diagram illustrating a water cooling jacket, with (a) being a plan view, (b) being a front view, and (c) being a bottom view.

A cooling unit 13 is provided between the pump main body 11 and the power unit 14 and cools heat generating members in the power unit 14, mainly electronic components of a motor drive circuit. As shown in FIG. 2, the cooling unit 13 includes a jacket main body 13*a* that is formed of a cooling water conduit inside thereof, a cooling water inlet 13*b* and a cooling water outlet 13*c* for circulating cooling water from a pump (not shown) through a cooling water conduit.

The pump main body 11 is provided with a casing 110. The casing 110 is provided with connection flanges 110UF, 110LF on the upper side and the lower side in FIG. 1. The base 12 is provided with a casing 120. The casing 120 is provided with connection flanges 120UF, 120LF on the upper side and the lower side in FIG. 1. The casings 110, 120 are called pump casings. The upper connection flange 110UF of the pump main body 11 is connected to the outlet port of the vacuum processing apparatus (not shown) with bolts 11B. The lower connection flange 110LF of the pump main body 11 is connected to the upper connection flange 120UF with bolts 12B. The lower connection flange 120LF of the base 12 is arranged on an upper side 13US of the cooling unit 13. The cooling unit 13 is fastened to a lower side of the base 12 with bolts 13B. The lower side of the cooling unit 13 abuts against an upper end of the casing 140 of the power unit 14 and the casing 140 is fastened to the cooling unit 13 with bolts 14B.

As shown in FIG. 2, the jacket main body 13*a* is in the form of a substantially octagonal flat plate and is provided with a terrace portion 13*e* having a substantially octagonal planar shape on the bottom. On an outer circumference of the jacket main body 13*a* is provided a projected portion 13*f* at every predetermined angular position. Each of the projected portions 13*f* is provided with a hole 13*g* for fastening the casing 140 of the power unit. On the terrace portion 13*e* is provided with screw holes 13*h* concentrically with the axis of rotation of the pump. As shown in FIG. 1, the upper side 13US of the jacket is arranged so as to abut against the lower connection flange 120LF of the casing 120 of the evacuation unit 12 and the bolts 13B are screw-fixed into the screw holes 13*h*, thus fastening the jacket main body 13*a* to the casing 120. The power unit 14 is fastened to the jacket main body 13*a* by arranging the power unit casing 140 so that the upper side of the power unit casing 140 abuts against the rear side 13LS of the jacket main body 13*a* and by fitting the bolts 14B in the screw holes of the power unit casing 140.

Figure 3:
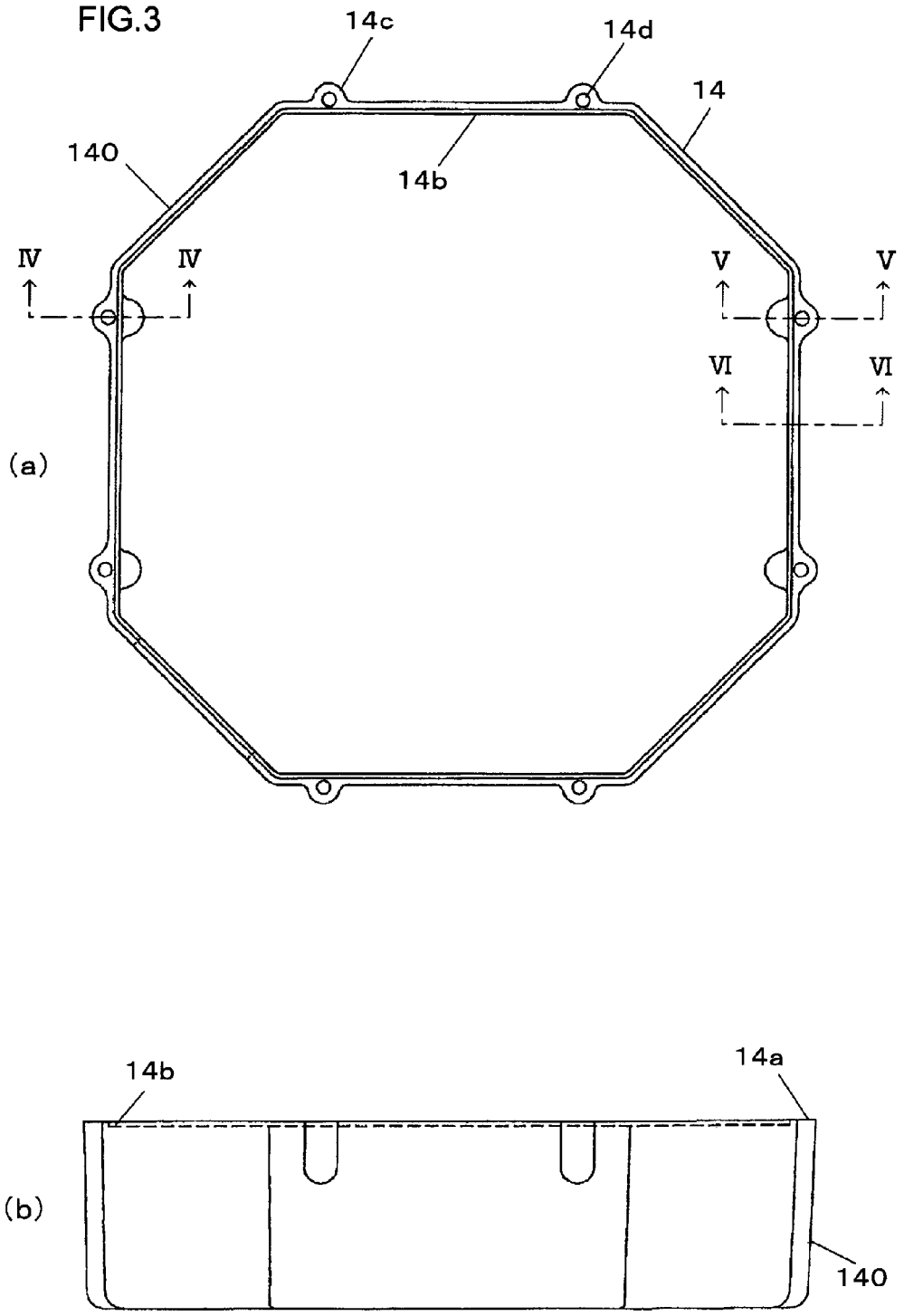
FIG. 3 A diagram illustrating a casing of a power unit, with (a) being a plan view and (b) being a front view.
Figure 4:
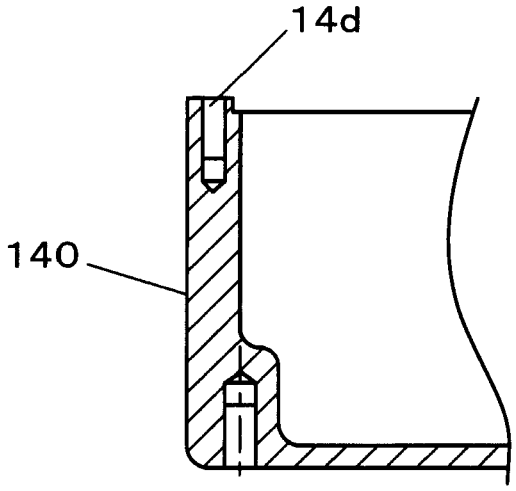
FIG. 4 A cross-sectional view along the line IV-IV in FIG. 3.
Figure 5:
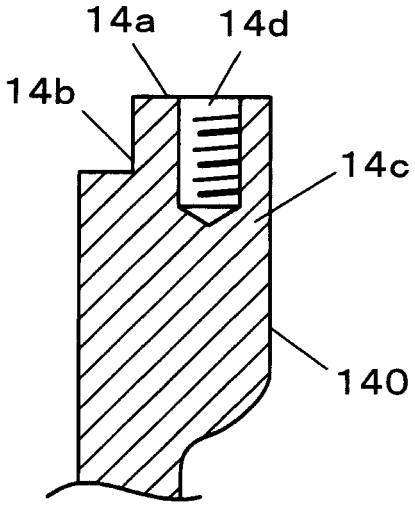
FIG. 5 A cross-sectional view along the line V-V in FIG. 3.
Figure 6:
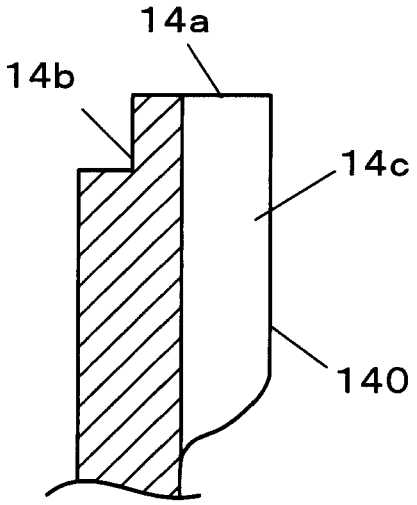
FIG. 6 A cross-sectional view along the line VI-VI in FIG. 3.
Figure 7:
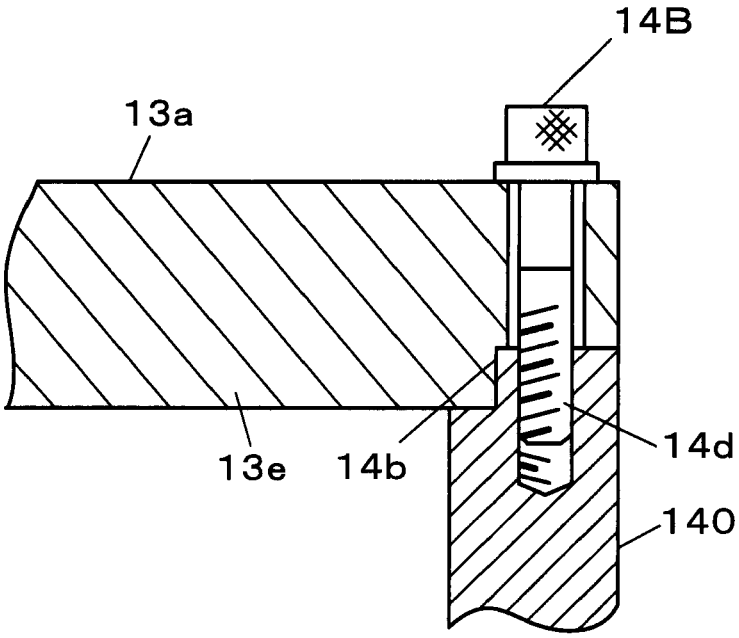
FIG. 7 A diagram illustrating a fitting structure between a jacket main body and a casing of the power unit.

The power unit casing 140 is explained with reference to FIG. 3. The power unit casing 140 is formed as an octagonal tube with a bottom (cf. FIG. 4). As shown in FIGS. 5 and 6 in enlarged views, on the open end 14*a* of the power unit casing 140 there are provided with a stepped portion 14*b* in a substantially octagonal shape along the entire circumference thereof. On the outer circumference of the open end 14*a* is provided a bulging portion 14*c* at every predetermined angular position. Each of the bulging portions 14*c* is provided with a screw hole 14*d* for fastening the power unit casing 140 to the jacket main body 13*a*. The terrace portion 13*e* of the jacket main body 13*a* is fitted into the stepped portion 14*b* as shown in FIG. 7. That is, the octagon-shaped circumference of the terrace portion 13*e* of the cooling unit 13 is fitted into the substantially octagon-shaped stepped portion 14*b*.

The power unit 14 is explained with reference to FIG. 8. The power unit 14 is supplied with alternating current power from a primary power source 15, and the alternating current is input to an AC/DC converter 14*a*. The voltage of the input alternating current power is detected by a voltage sensor 14*b*. The AC/DC converter 14*a* converts the alternating current power supplied from the primary power source 15 into direct current power. The direct current power output from the AC/DC converter 14*a* is input to a 3-phase inverter 14*c* for driving a motor 16 and a DC/DC converter 14*d*. The voltage of the direct current power input to the DC/DC converter 14*d* is detected by a voltage sensor 14*e*. The output of the DC/DC converter 14*d* is input to an inverter control circuit 14*f* that controls the 3-phase inverter 14*c* by PWM control or the like and a magnetic bearing control unit 14*g* that controls magnetic levitation by the magnetic bearing 17.

The magnetic bearing control unit 14*g* includes a control unit 141*g* that performs bearing control and an excitation amplifier 142*g* that supplies excitation current to the magnetic bearing 17 based on a control signal calculated by the control unit 141*g*.

The number of rotations of the rotor 20 detected by a rotation number sensor 19 is input to the inverter control circuit 14*f*, which controls the 3-phase inverter 14*c* based on the input rotation number of the rotor. Symbol 14*h* indicates a regeneration brake resistor (sheathed heater) for consuming regeneration surplus power, which consumes regeneration power at the time of speed reduction of the rotor by means of the regeneration brake resistor 14*h*. On/off of the current that flows through the regeneration brake resistor 14*h* is controlled by controlling the on/off of a transistor 14*j* by a transistor control circuit 14*i*. Symbol 14*k* indicates a diode for preventing reverse flow of power upon regeneration.

Figure 9:
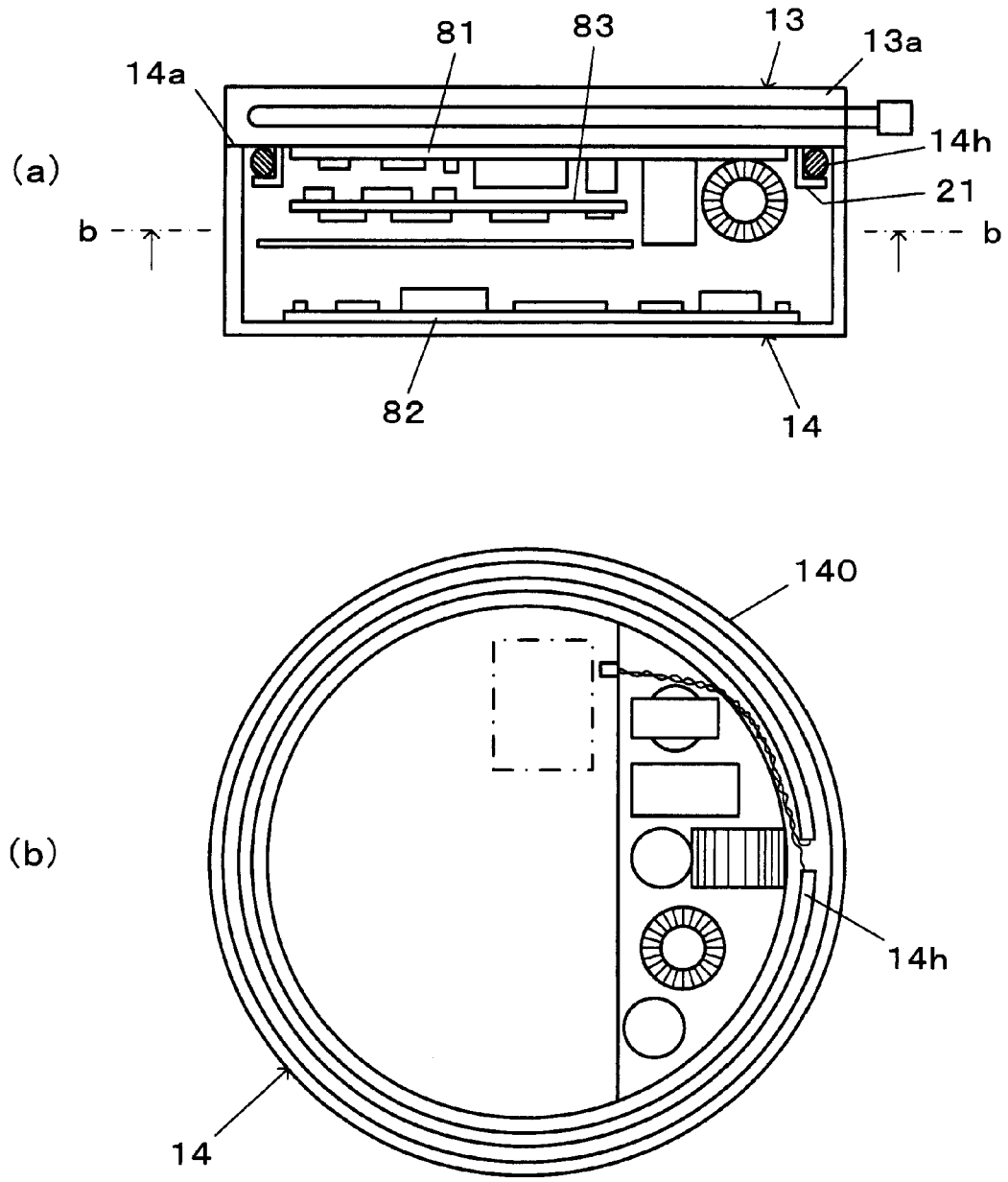
FIG. 9 (*a*) being a cross-sectional view showing the inside of the casing 140 and (*b*) being a cross-sectional view of the device along the line b-b.

FIG. 9 is a diagram showing a specific layout of elements and of substrates of the power unit 14. FIG. 9(*a*) presents a longitudinal cross-section of the jacket main body 13*a* and the power unit 14. FIG. 9(*b*) presents a cross-sectional view along the line b-b in (a). The motor drive circuit unit is a bulk power unit that supplies power to the motor. It includes the regeneration brake resistor 14*h*, which is a heat generating device upon regeneration, so that it is arranged just below the cooling unit 13.

Figure 8:
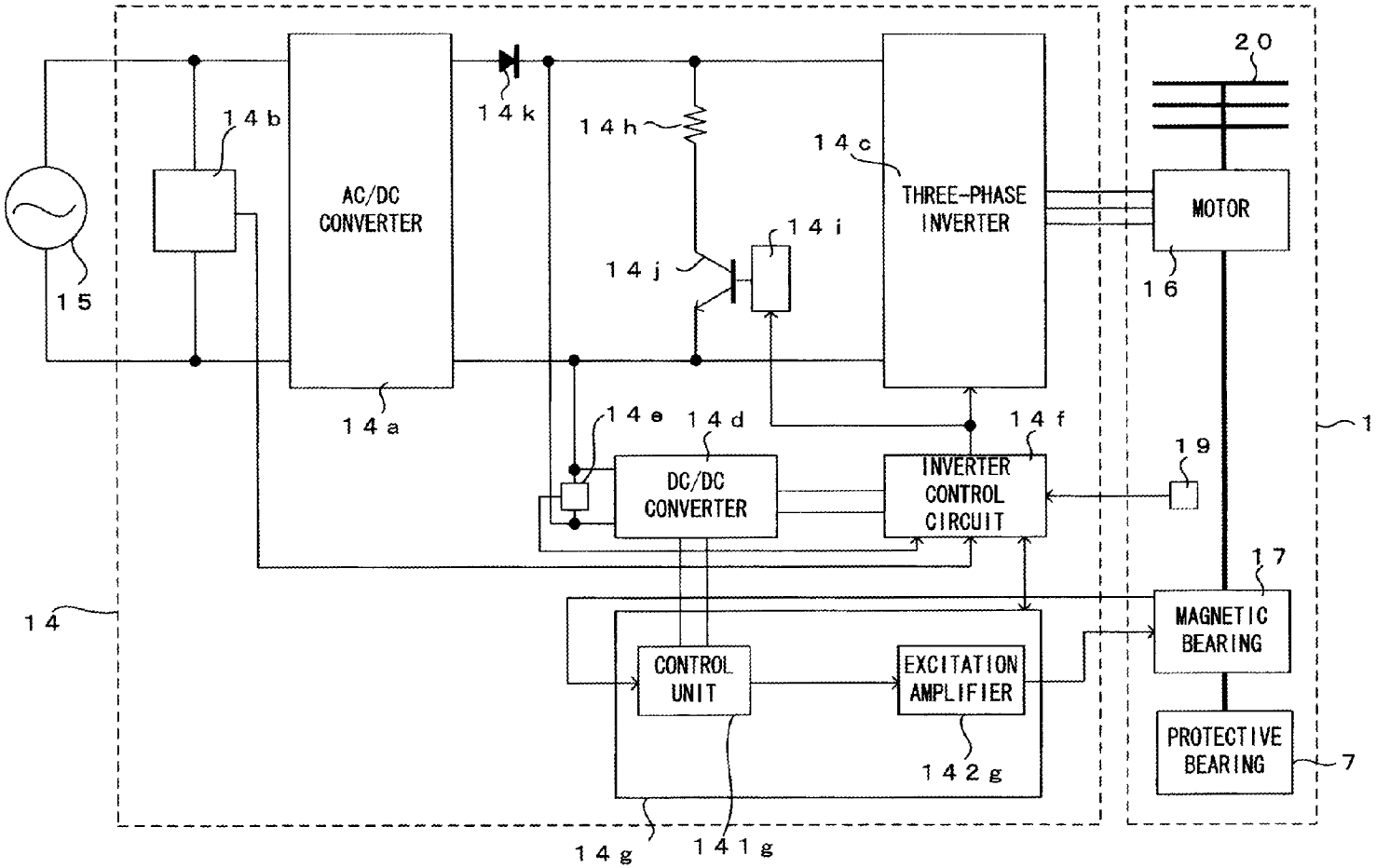
FIG. 8 A block diagram showing details of a control unit 14.

As illustrated in FIG. 8, the power unit 14 includes a motor drive circuit unit and a magnetic bearing control unit and various components thereof are arranged on a plurality of substrates 81 to 83 separately as shown in FIG. 9(*a*). According to this embodiment, these components are classified, depending on amount of heat generation and on resistance to high temperatures, into three groups, i.e., intensive cooling required components 50, moderate cooling required components 60 and no cooling required components 70. These components are arranged on different substrates 81 to 83, respectively.

Figure 11:
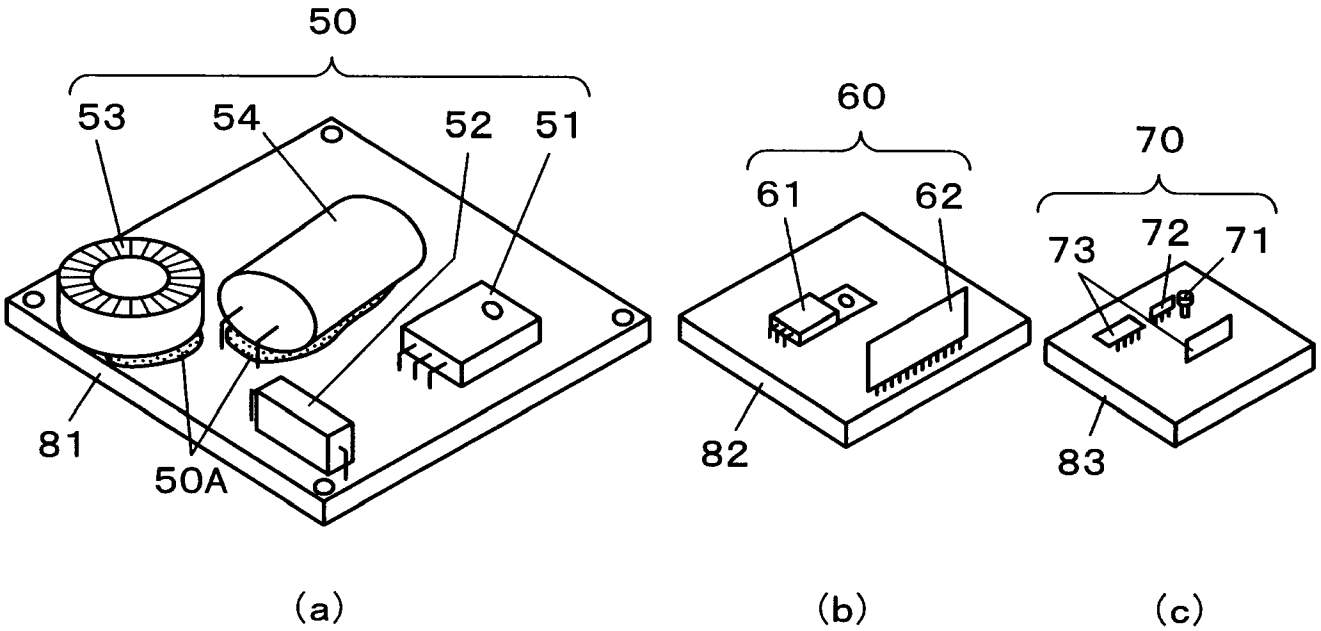
FIG. 11 Figures showing a component which requires intensive cooling, a component which requires moderate cooling, and a component which requires no cooling and substrates on which respective components are installed.

The intensive cooling required components 50 are components that require intensive cooling. They include, for example, a power device 51 or a resistor 52, a power coil transformer 53, a large electrolytic capacitor and so on that generate heat of about 5 W or more as shown in FIG. 11. The moderate cooling required components 60 are components that require cooling but do not require intensive cooling unlike the intensive cooling required components. They include a power element 61 whose heat generation is less than about 5 W and an electronic circuit component 62 that consumes power to some extent. The no cooling required components 70 include a transistor 71, a resistor/capacitor 72, an IC 73 and so on that consume small amounts of power, respectively, and require substantially no cooling.

The substrate 81 on which the intensive cooling required components 50 are mounted is a high heat-conductive substrate. On a side on which the components are mounted is provided with an insulation film through which the components 50 and wiring are arranged. The high heat-conductive substrate 81 is fixed to the jacket main body 13A inside the ring-shaped regeneration brake resistor 14*h* such that the rear side surface (the side opposite to the component mounting side) of the substrate is almost entirely in contact with the lower side of the jacket main body 13A of the cooling unit 13. Therefore, the intensive cooling required components 50 can be highly cooled by the cooling unit 13 through the high heat-conductive substrate 81. For the components 50 that particularly require intensive cooling, a heat conductive compound 50A is provided between the components 50 and the component mounting side of the substrate 81 to further increase the efficiency of cooling.

The substrate 82 on which moderate cooling required components 60 are mounted is a high heat-conductive substrate and the component mounting side thereof is provided with an insulation film. The components 60 and wiring patterns are arranged on the insulation film. The rear side (the side opposite to the component mounting side) of the substrate 82 is fixed so that the rear side of the substrate 82 is almost entirely in contact with the bottom side of the power unit casing 140. Therefore, the heat generated in the moderate cooling required components 60 is efficiently dissipated to the external air through the high heat-conductive substrate 82 and the power unit casing 140. Although the absolute cooling efficiency of is lower than that of the intensive cooling required components 50, a sufficient cooling is achieved for the moderate cooling required components 60.

Figure 12:
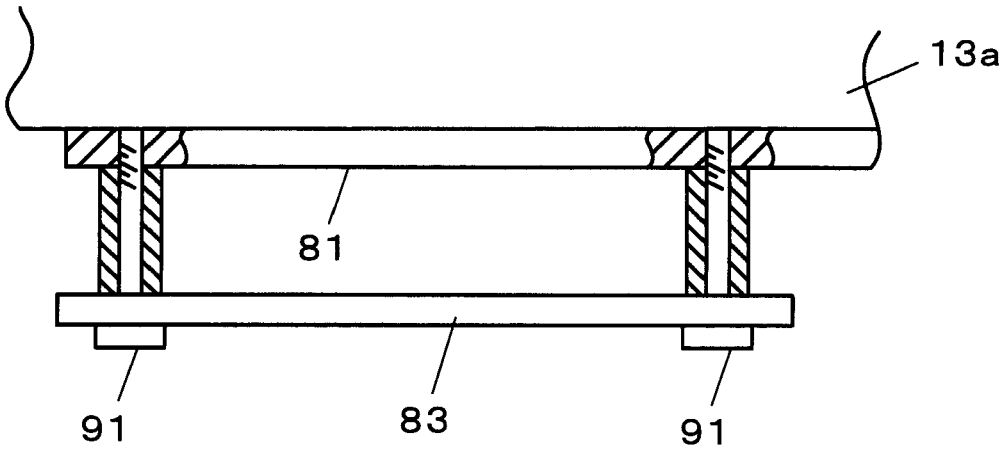
FIG. 12 A figure illustrating how to support the substrate on which the component that requires no cooling is installed.

The substrate 83 on which the no cooling required components 70 are mounted is made of glass epoxy or phenol resin. The substrate 83 is arranged in a space between the high heat-conductive substrates 81 and 82, separated from these substrates. For example, as shown in FIG. 12, the substrate 83 can be supported on the high heat-conductive substrate 81 by supporting members 91 such as stud bolts. The substrate 83 may be supported on the water cooling jacket main body 13A instead of the high heat-conductive substrate 81. The substrate 83 is not a high heat-conductive substrate and is arranged at a position where heat dissipation is not much expected for those no cooling required components 70. However, since the components 70 are components that require no cooling, there occurs no problem. It should be noted that, if there is a temperature gradient between the no cooling required components 70 and the surrounding members, the no cooling required components 70 are cooled by heat radiation or by heat conduction through local convection.

As mentioned above, the components of the power unit 14 are classified into the intensive cooling required components 50, the moderate cooling required components 60, and the no cooling required components 70. The intensive cooling required components 50 are arranged in a first space where the components are cooled by heat transfer to the water cooling unit 13, the moderate cooling required component s 60 are arranged in a second space where the components are cooled by heat transfer to the inner surface of the casing 140, and the no cooling required components 60 are arranged in a third space where the components are cooled by heat radiation or by heat transfer to the surrounding members through local convection in the casing 140. Therefore, components that require cooling can be cooled efficiently depending on the extent to which cooling is required, and there is no need to install a cooling fan.

In particular, in the power unit 14 according to the above-mentioned embodiment, the intensive cooling required components 50 and the moderate cooling required components 60 are mounted on high heat-conductive substrates, respectively, and the substrates are arranged in contact with the water cooling unit 13 or the inner surface of the casing 140 to cool the substrates by heat transfer. To this end, therefore, it is only necessary to arrange the substrates with components already mounted to be in contact with the water cooling unit 13 or the bottom of the casing 140, thereby facilitating an effective assembly work.

Figure 10:
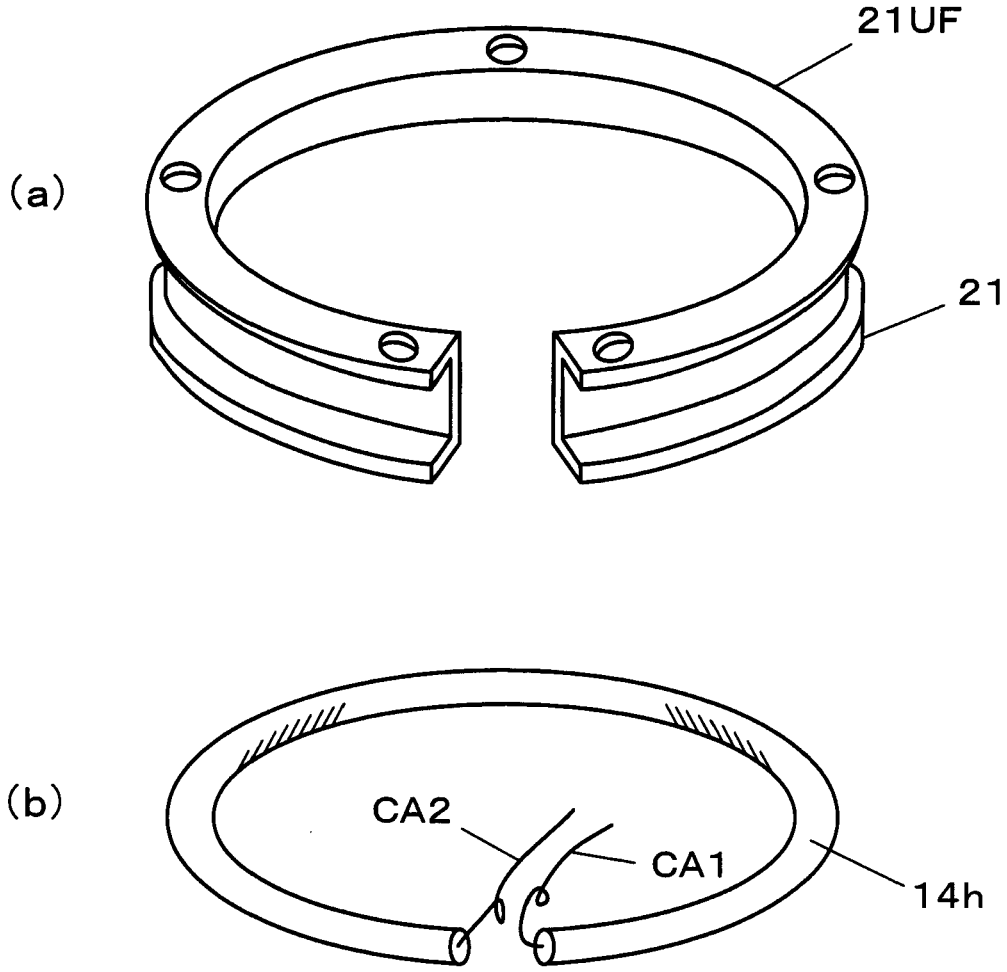
FIG. 10 Figures for explaining a bracket with which a sheathed heater is attached to the cooling device.

FIG. 10(*b*) shows the external view of regeneration brake resistor 14*h*. FIG. 10(*a*) is a perspective view of a mounting bracket. The regeneration brake resistor 14*h* may be, for example, a sheathed heater, which is formed as a C-shaped ring that has a shape corresponding to the contour of the bottom of the jacket main body 13*a*. One terminal of the regeneration brake resistor 14*h* is connected to a positive electrode line of the AC/AC converter with a cable CA1 and the other terminal of the regeneration brake resistor 14*h* is connected to a collector terminal of the transistor 14*i* with a cable CA2.

As shown in FIG. 10(*a*), mounting holes are provided in the upper flange 21UF of the mounting bracket 21. The mounting bracket 21 is fixed to the jacket main body 13*a* by bolts (not shown) that are inserted through the mounting holes and screw-fixed in the threaded holes of the jacket main body 13*a*. The mounting bracket 21 has an outer diameter slightly smaller than the inner diameter of the power unit casing 140 and the outer diameter of the jacket main body 13*a*. As shown in FIG. 9(*a*), the mounting bracket 21 is provided at the inner area along the inner circumference of the open end of the power unit casing 140 that is connected to the jacket main body 13*a*. On the bottom surface of the U-shaped cross-section is arranged the sheathed heater 14*h* such that it is wound around the mounting bracket 21 and fixed thereto with fixing means (not shown). As mentioned above, the sheathed heater 14*h* is arranged so as to extend along the inner circumference of the end portion at which the casing 140 contacts the cooling unit 13. In other words, the sheathed heater 14*h* is formed in a shape that corresponds to the shape of the inner periphery of the casing 140 before it is arranged. The space in which the sheathed heater 14*h* is arranged is a space where substrates and elements of the motor drive control unit, magnetic bearing control unit and so on cannot be arranged. Therefore, space utilization efficiency of layout of various elements within the power unit casing 140 can be improved, which contributes to down-sizing of the power unit 14.

Because the regeneration brake resistor 14*h* is attached to the cooling unit 13 through the bracket 21 made of a heat-conductive material, the heat generated when the regeneration brake is operated is transferred to the cooling unit 13. As a result, an excessive increase in temperature can be suppressed.

It is to be notified that the sheathed heater 14*h* may be fixed by using a plurality of clasps fixed on the bottom of the jacket main body 13*a* at predetermined intervals along the contour of the sheathed heater 14*h* instead of the mounting bracket 21. In this case, if the sheathed heater 14*h* is pressed against the bottom of the jacket main body 13*a*, the heat conductivity can be improved. The shape of the regeneration brake resistor need not be ring-shaped as shown in FIG. 10 but any suitable shape may be adopted as far as heat dissipation to the jacket main body 13*a* is possible.

In the turbomolecular pump device 10 according to an embodiment, the jacket main body 13*a* and the power unit 140 are fitted with each other by means of the substantially octagonal terrace portion 13*e* and the substantially octagonal stepped portion 14*b* to constitute a torque reaction structure. When the rotor of the pump main body 11 is in contact with the inner circumference of the pump casing due to disturbance, impact torque is generated. With this impact torque, when the pump casing 110 rotates relatively with respect to the vacuum processing device until it stops, inertial forces act on the cooling unit 13 and the power unit 14 due to their own weights so that the torque due to inertial forces act on the fastening portion (first fastening portion) in which the evacuation casing 120 and the cooling unit 13 are fastened to each other. Also, the torque due to inertial forces is applied to a fastening portion (second fastening portion) in which the cooling unit 13 and the power unit casing 140 are fastened to each other. The inertial torque due to self-weight of the power unit 14 is transferred from the substantially octagonal circumferential stepped portion 14*b* to the octagonal terrace portion 13*e* of the jacket main body 13*a*. Since the jacket main body 13*a* is fastened to the evacuation casing 120 with the bolts 13B, the shear force due to inertial torque acts on the bolts 13B. As a result, no large shear force due to the inertial force acts on the bolts 14B that fasten the jacket main body 13*a* to the power unit casing 140. Therefore, the diameter of the bolts 14B may be set relatively small since it is unnecessary to take inertial torque into consideration.

The turbomolecular pump device according to above-mentioned embodiment may be modified as follows.

(1) The intensive cooling required components 50 are mounted on the high heat-conductive substrate 81, and this substrate 81 is attached in contact with the cooling unit 13. However, the intensive cooling required components 50 may be attached to the cooling unit 13 in its insulated state. When the components themselves are not insulated, they are attached to the cooling unit through an insulation sheet having good heat conductivity.

(2) The moderate cooling required components 60 are mounted on the high heat-conductive substrate 82, and this substrate 82 is attached in contact with the inner surface of the casing 140. However, the moderate cooling required components 60 may be attached to the inner surface of the casing 140 in their insulated state. When the components themselves are not insulated, they are attached to the inner surface of the casing 140 via an insulation sheet having good heat conductivity.

It is to be notified that as far as the features of the present invention are not damaged, the present invention is not limited to the above-mentioned embodiments.

Therefore, the present invention can be applied to various types of turbomolecular pumps including a power unit 14 that drives a turbomolecular pump main body and a water cooling unit 13 inserted between the turbomolecular pump main body 11 and the power unit 14, wherein components provided in the casing 140 of the power unit 14 are classified into the intensive cooling required components 50 that require intensive cooling, the moderate cooling required components 60 that require moderate cooling, and the no cooling required components 70 that require substantially no cooling and the intensive cooling required components 50 are arranged in the first space where the intensive cooling required components 50 are cooled by heat transfer to the water cooling unit 13, the moderate cooling required components 60 are arranged in the second space where the moderate cooling required components 60 are cooled by heat transfer to the inner surface of the casing 140, and the no cooling required components 70 are arranged in the third space where the no cooling required components 70 are cooled in the casing 140 by radiation or local convection.

The invention claimed is:

1. A power unit suitable for a turbomolecular pump device comprising a turbomolecular pump main body including a rotor with rotary vanes, stator vanes and a motor that drives the rotor to rotate, the power unit comprising:

regeneration brake resistor that converts regeneration power from the motor into heat; and a water cooling unit that is provided between the turbomolecular pump main body and the power unit, wherein the regeneration brake resistor is connected to an attaching member connected to a lower side of the water cooling unit, the attaching member being made of a heat-conductive material.

2. A power unit suitable for a turbomolecular pump device according to claim 1, wherein the attaching member is screw-fixed to the water cooling unit by a bolt.

3. A power unit suitable for a turbomolecular pump device according to claim 1, wherein the regeneration brake resistor is attached to the lower side of the water cooling unit through the attaching member at an inner area of the power unit.

4. A power unit suitable for a turbomolecular pump device according to claim 1, wherein, the attaching member is formed by a ti-shaped cross-section to which the regeneration brake resistor is arranged.

5. A turbomolecular pump device, comprising:

the power unit and the turbomolecular pump main body according to claim 1.

6. A power unit suitable for a turbomolecular pump device comprising a turbomolecular pump main body including a rotor with rotary vanes, stator vanes and a motor that drives the rotor to rotate, the power unit comprising:

regeneration brake resistor that converts regeneration power from the motor into beat; and a water cooling unit that is provided between the turbomolecular pump main body and the power unit, wherein the regeneration brake resistor is connected to a member connected to a lower side of the water cooling unit, the member being made of a heat-conductive material.

7. A turbomolecular pump device, comprising:

the power unit and the turbomolecular pump main body according to claim 6.

8. A power unit suitable for a turbomolecular pump device comprising the turbomolecular pump main body including a rotor with rotary vanes, stator vanes and a motor that drives the rotor to rotate, the power unit comprising:

a regeneration brake resistor that converts regeneration power from the motor into heat; and a water cooling unit that is provided between the turbomolecular pump main body and the power unit, wherein the regeneration brake resistor is arranged in contact with the water cooling unit.

9. A turbomolecular pump device, comprising:

the power unit and the turbomolecular pump main body according to claim 8.

* * * * *